US010419851B2

(12) United States Patent
Chen

(10) Patent No.: US 10,419,851 B2
(45) Date of Patent: Sep. 17, 2019

(54) RETAINING BINAURAL CUES WHEN MIXING MICROPHONE SIGNALS

(71) Applicant: Cirrus Logic International Semiconductor Ltd., Edinburgh (GB)

(72) Inventor: Henry Chen, Cremorne (AU)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/304,728

(22) PCT Filed: Apr. 17, 2015

(86) PCT No.: PCT/AU2015/050182
§ 371 (c)(1),
(2) Date: Oct. 17, 2016

(87) PCT Pub. No.: WO2015/157827
PCT Pub. Date: Oct. 22, 2015

(65) Prior Publication Data

US 2017/0041707 A1 Feb. 9, 2017

(30) Foreign Application Priority Data

Apr. 17, 2014 (AU) ..... 2014901429

(51) Int. Cl.
*H04R 3/00* (2006.01)
*H04R 1/26* (2006.01)
*H04S 7/00* (2006.01)

(52) U.S. Cl.
CPC ..... *H04R 3/005* (2013.01); *H04R 1/265* (2013.01); *H04S 7/30* (2013.01); *H04R 2410/07* (2013.01);
(Continued)

(58) Field of Classification Search
None
See application file for complete search history.

(56) References Cited

U.S. PATENT DOCUMENTS 5,371,802 A * 12/1994 McDonald ..... G10K 15/02 381/110
8,473,287 B2 6/2013 Every et al.
(Continued)

FOREIGN PATENT DOCUMENTS

WO 2015003220 A1 1/2015

OTHER PUBLICATIONS

Welker, Daniel P., et al. "Microphone-array hearing aids with binaural output. II. A two-microphone adaptive system." IEEE Transactions on Speech and Audio Processing 5.6 (1997): 543-551.*

(Continued)

*Primary Examiner* — Maria El-Zoobi
*Assistant Examiner* — Kenny H Truong
(74) *Attorney, Agent, or Firm* — Jackson Walker L.L.P.

(57) ABSTRACT

A method of mixing microphone signals. First and second microphone signals are obtained from respective first and second microphones. In at least one affected subband, the first and second microphone signals are mixed to produce first and second mixed signals. At least one reference subband of the first and second microphone signals is processed in order to identify a binaural cue between the first and second microphone signals, the reference subband being distinct from the or each affected subband. The affected subband in the first and second mixed signals is modified in order to re-emphasize the identified binaural cue.

13 Claims, 4 Drawing Sheets

(52) U.S. Cl.
CPC ..... *H04R 2430/03* (2013.01); *H04S 2400/15* (2013.01); *H04S 2420/01* (2013.01)

(56) References Cited

U.S. PATENT DOCUMENTS

| | | | | |
|---|---|---|---|---|
| 2002/0041695 | A1 | 4/2002 | Luo | |
| 2009/0304188 | A1 | 12/2009 | Mejia et al. | |
| 2010/0280824 | A1* | 11/2010 | Petit | G10L 21/0208 704/214 |
| 2011/0129105 | A1* | 6/2011 | Choi | H04R 3/005 381/313 |
| 2013/0010972 | A1 | 1/2013 | Ma | |
| 2014/0161271 | A1* | 6/2014 | Teranishi | H04R 5/04 381/71.7 |
| 2014/0226842 | A1* | 8/2014 | Shenoy | H04N 7/147 381/303 |
| 2016/0155453 | A1* | 6/2016 | Harvey | H04R 3/005 381/26 |

OTHER PUBLICATIONS

F. L. Wightman and D. J. Kistler, "The dominant role of low-frequency interaural time differences in sound localization," J. Acoust. Soc. Amer., vol. 91, pp. 1648-1661, Mar. 1991.*

International Search Report and Written Opinion of the International Searching Authority, International Application No. PCT/AU2015/050182, dated Jun. 2, 2015.

Australian Patent Office International-Type Search Report, National Application No. 2014901429, dated Nov. 18, 2014.

Wikipedia, "Sound localization", https://en.wikipedia.org/wiki/Sound_localization, retrieved Oct. 30, 2017.

* cited by examiner

RETAINING BINAURAL CUES WHEN MIXING MICROPHONE SIGNALS

CROSS-REFERENCE TO RELATED APPLICATIONS

This application claims the benefit of Australian Provisional Patent Application No. 2014901429 filed 17 Apr. 2014, which is incorporated herein by reference.

TECHNICAL FIELD

The present invention relates to the digital processing of signals from microphones or other such transducers, and in particular relates to a device and method for mixing signals from multiple such signals in order to achieve a desired function, while retaining spatial or directional cues in the signals.

BACKGROUND OF THE INVENTION

Natural human hearing provides stereo perception whereby a listener can discriminate the direction from which a sound originates. This listening ability arises because the time of arrival of an acoustic signal at each respective ear of the listener depends on the angle of incidence of the acoustic signal. The amplitude of the acoustic signal at each respective ear of the listener can also depend on the angle of incidence of the acoustic signal. The difference between the time of arrival of the acoustic signal at each respective ear of the listener, and the amplitude of the acoustic signal at each respective ear of the listener, are examples of binaural cues which enrich the hearing perception of the listener and can enable certain tasks or effects. However, when acoustic sound is processed by a digital signal processing device and delivered to each respective ear of the user by a speaker, such binaural cues are often lost.

Processing signals from microphones in consumer electronic devices such as smartphones, hearing aids, headsets and the like presents a range of design problems. There are usually multiple microphones to consider, including one or more microphones on the body of the device and one or more external microphones such as headset or hands-free car kit microphones. In smartphones these microphones can be used not only to capture speech for phone calls, but also for recording voice notes. In the case of devices with a camera, one or more microphones may be used to enable recording of an audio track to accompany video captured by the camera. Increasingly, more than one microphone is being provided on the body of the device, for example to improve noise cancellation as is addressed in GB2484722 (Wolfson Microelectronics).

The device hardware associated with the microphones should provide for sufficient microphone inputs, preferably with individually adjustable gains, and flexible internal routing to cover all usage scenarios, which can be numerous in the case of a smartphone with an applications processor. Telephony functions should include a "side tone" so that the user can hear their own voice, and acoustic echo cancellation. Jack insertion detection should be provided to enable seamless switching between internal to external microphones when a headset or external microphone is plugged in or disconnected.

Wind noise detection and reduction is a particularly difficult problem in such devices. Wind noise is defined herein as a microphone signal generated from turbulence in an air stream flowing past microphone ports, as opposed to the sound of wind blowing past other objects such as the sound of rustling leaves as wind blows past a tree in the far field. Wind noise can be objectionable to the user and/or can mask other signals of interest. It is desirable that digital signal processing devices are configured to take steps to ameliorate the deleterious effects of wind noise upon signal quality. One such approach is described in International Patent Publication No. WO 2015/003220 by the present applicant, the content of which is incorporated herein by reference. This approach involves mixing the signals from at least two microphones so that the signal which is suffering from least wind noise is preferentially used for further processing. Such mixing is applied at low frequencies (e.g. less than 3-8 kHz), with higher frequencies being retained in separate channels. Other applications may require subband mixing at mid- and/or high frequencies in the audio range. However these and other methods of microphone signal mixing can corrupt the binaural cues being delivered to the listener.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect the present invention provides a method of mixing microphone signals, the method comprising:

obtaining first and second microphone signals from respective first and second microphones;

in at least one affected subband, mixing the first and second microphone signals to produce first and second mixed signals;

processing at least one reference subband of the first and second microphone signals in order to identify a binaural cue between the first and second microphone signals, the reference subband being distinct from the or each affected subband; and modifying the affected subband in the first and second mixed signals in order to re-emphasize the identified binaural cue.

According to a second aspect the present invention provides a device for mixing microphone signals, the device comprising:

first and second inputs for receiving respective first and second microphone signals from respective first and second microphones; and a digital signal processor configured to, in at least one affected subband, mix the first and second microphone signals to produce first and second mixed signals; the digital signal processor further configured to process at least one reference subband of the first and second microphone signals in order to identify a binaural cue between the first and second microphone signals, the reference subband being distinct from the or each affected subband; and the digital signal processor further configured to modify the affected subband in the first and second mixed signals in order to re-emphasize the identified binaural cue.

According to a third aspect the present invention provides a non-transitory computer readable medium for mixing microphone signals, comprising instructions which, when executed by one or more processors, causes performance of the following:

obtaining first and second microphone signals from respective first and second microphones;

in at least one affected subband, mixing the first and second microphone signals to produce first and second mixed signals;

processing at least one reference subband of the first and second microphone signals in order to identify a binaural cue between the first and second microphone signals, the reference subband being distinct from the or each affected subband; and modifying the affected subband in the first and second mixed signals in order to re-emphasize the identified binaural cue.

In some embodiments, identifying the binaural cue may comprise analysing the reference subband in the first and second signals in order to identify a level, magnitude or power difference between the first and second signals in the reference subband. In such embodiments, modifying the affected subband in the first and second mixed signals may comprise applying respective first and second emphasis gains to the first and second mixed signals in the or each affected subband, the first and second emphasis gains being selected to correspond to the identified level, magnitude or power difference between the first and second signals in the reference subband.

In some embodiments, identifying the binaural cue may comprise analysing the reference subband in the first and second signals in order to identify a time difference between the first and second microphone signals. In such embodiments, modifying the affected subband in the first and second mixed signals may comprise applying an emphasis delay to completely or partly restore the identified time difference to the first and second mixed signals in the or each affected subband.

In some embodiments, the binaural cue comprises both a delay between the microphone signals and a signal level difference between the microphone signals, whereby both emphasis gains and an emphasis delay are applied to the first and second mixed signals in the or each affected subband.

In some embodiments the mixing may comprise mixing the signals from at least two microphones, in low frequency subbands, so that the signal which is suffering from least wind noise in each of the low frequency subbands is preferentially used in that subband for further processing in both of the mixed signals.

In other embodiments, the mixing may comprise mixing the signals from at least two microphones, in middle-to-high frequency subbands, so that the signal which is suffering from least lens focus motor noise in each of the affected subbands is preferentially used in that subband for further processing in both of the mixed signals.

BRIEF DESCRIPTION OF THE DRAWINGS

An example of the invention will now be described with reference to the accompanying drawings, in which.

DESCRIPTION OF THE PREFERRED EMBODIMENTS

Focus noise in video recording, being the noise of an auto focus motor of the lens of the video camera, is a situation where subband mixing between multiple microphone signals may be applied for example between about 4 kHz and 12 kHz. The following description uses subband signal mixing to ameliorate focus noise as an example, however it is to be appreciated that other embodiments of the present invention may be applied to low frequency subband mixing to address wind noise, for example.

Figure 1:
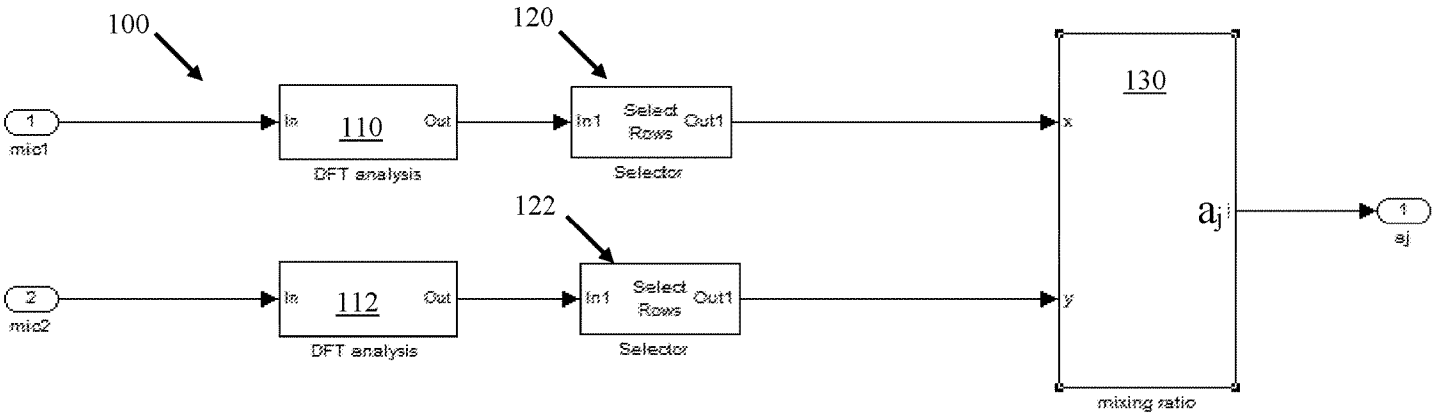
FIG. 1 is a schematic of a system for determining a mixing ratio in each of one or more affected subbands.

FIG. 1 shows part of a system 100 for mixing 2 microphone signals. If it is supposed that the mic1 signal is more affected by focus noise than the mic 2 signal, then the system is configured to mix the microphone signals in affected subbands, and to use the mixed output as the new mic1 output, so that the mixed output suffers less noise as a result of the mixing. The inverse applies when the mic2 signal is more affected by noise. To achieve this, both microphone signals are analysed at 110, 112 using DFT or any other suitable subband analysis method, and the two selectors 120, 122 select which subbands are affected subbands that are to be mixed. The mixing ratio module 130 of FIG. 1 calculates the mixing ratio in each affected subband selected by the selectors. $a_j$ is the mixing ratio applied on mic1 and $(1-a_j)$ is the mixing ratio applied on mic2, and j is the subband index. In this mixing procedure, stereo or binaural cues will be diminished or lost because the mixed signal and mic2 signal are being made more similar or even identical in each affected subband.

Figure 2:
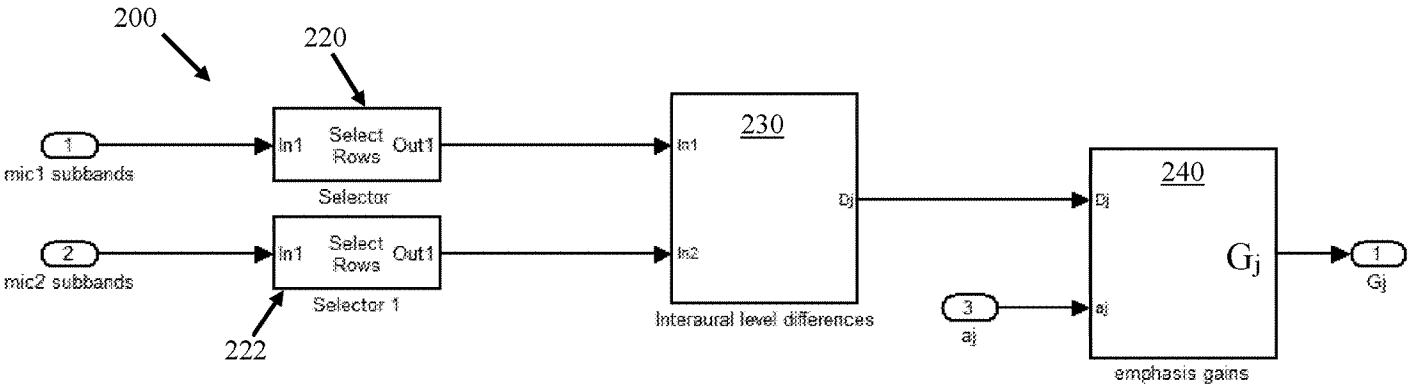
FIG. 2 is a schematic of a system for assessing inter-aural level differences in reference subbands in order to determine suitable emphasis gains to be applied to each of one or more affected subbands in accordance with a first embodiment of the invention.

FIG. 2 is a schematic of a system 200 for assessing inter-aural level differences in reference subbands in order to determine suitable emphasis gains to be applied to each of one or more affected subbands in accordance with a first embodiment of the invention. The two selectors 220, 222 select which subbands are affected subbands that are to be mixed. The Interaural level differences (ILD) module 230 calculates the inter aural level differences $D_j$ (also referred to as $ILD_j$). The emphasis gains module 240 uses the $D_j$ and $a_j$ values to calculate emphasis gains $G_j$ using the equation:

$$G_j=(1-a_j)*(ILD_j-1)+1$$

The gain $G_j$ is one (0 dB gain) if the mixing ratio is 1 (no mixing), or if the $ILD_j$ is 1 (i.e. mic1 and mic2 signals are of the same level). The calculation of Gj in other embodiments can take different forms, such as:

$$G_j=(1-a_j)^2*(ILD_j-1)+1;$$

Figure 3:
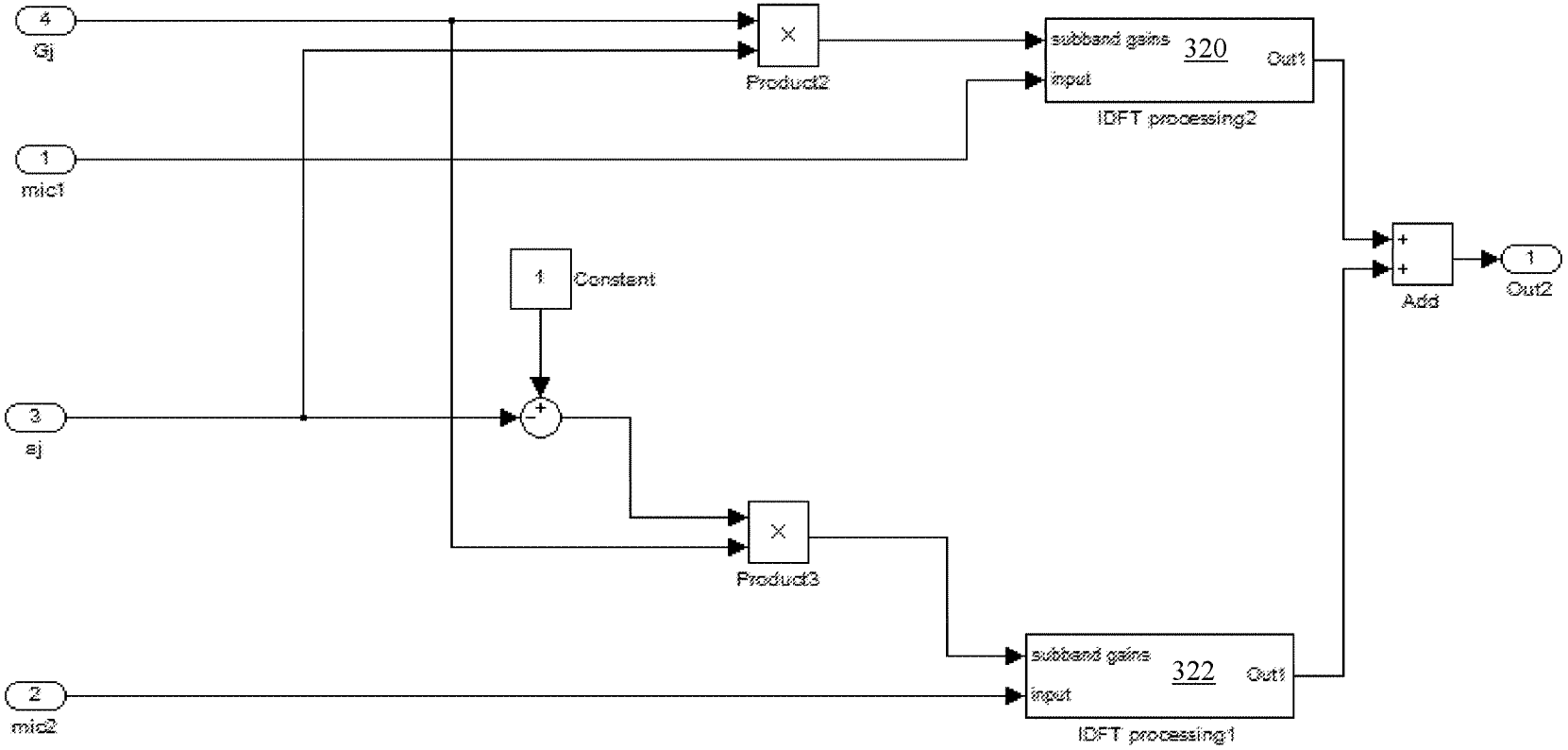
FIG. 3 is a schematic of a system for applying emphasis gains to affected subbands in the embodiment of FIG. 2.

FIG. 3 shows the subband gains being applied on both microphones before mixing. The emphasis gains are applied to emphasize the difference between the mixed output and the mic2 output, and thereby re-emphasise binaural cues carried by such level differences. The total subband gains (including mixing, emphasis gain) applied by block 320 on mic1 are aj*Gj. The total subband gains applied by block 322 on mic2 are (1−aj)*Gj.

Figure 4:
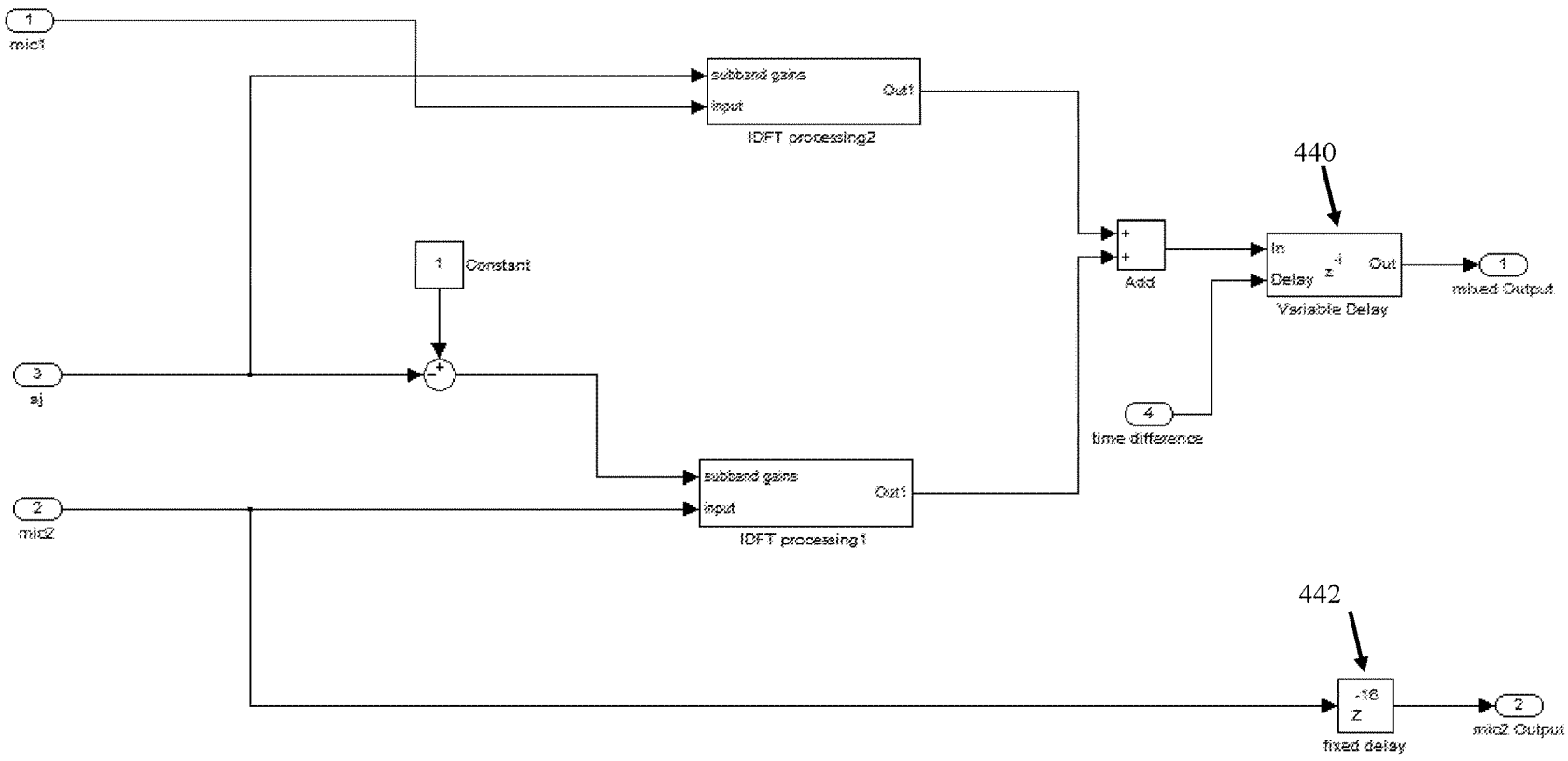
FIG. 4 is a schematic of a system for applying a time difference to affected subbands in accordance with another embodiment of the invention; and'

FIG. 4 shows an embodiment in which a time difference is applied by block 440 on the mixed output, in order to re-emphasise binaural cues. A fixed delay is applied by block 442 on mic2 in case the time difference is a negative value, i.e. when sounds arrive at mic1 earlier than at mic2. In this embodiment, the time difference of arrival (TDOA) between the two microphones is calculated using a generalized correlation method (C. H. Knapp and G. C. Carter, "The generalized correlation method for estimation of time delay," IEEE Trans. Acoust., Speech, Signal Processing vol. 24, pp. 320-327, August 1976). The time difference is then applied on the mixed output for those subbands affected by noise, so that after the mixing the mixed output and mic2 will have the same time difference as the original mic1 and mic2 signals, thus better preserving binaural cues. The fixed delay applied at 442 is the microphone spacing between mic1 and mic2 divided by the sampling rate.

In alternative embodiments similar to FIG. 4, the time difference of arrival could instead be calculated during the IDFT stage using the phase shift of reference subbands.

Figure 5:
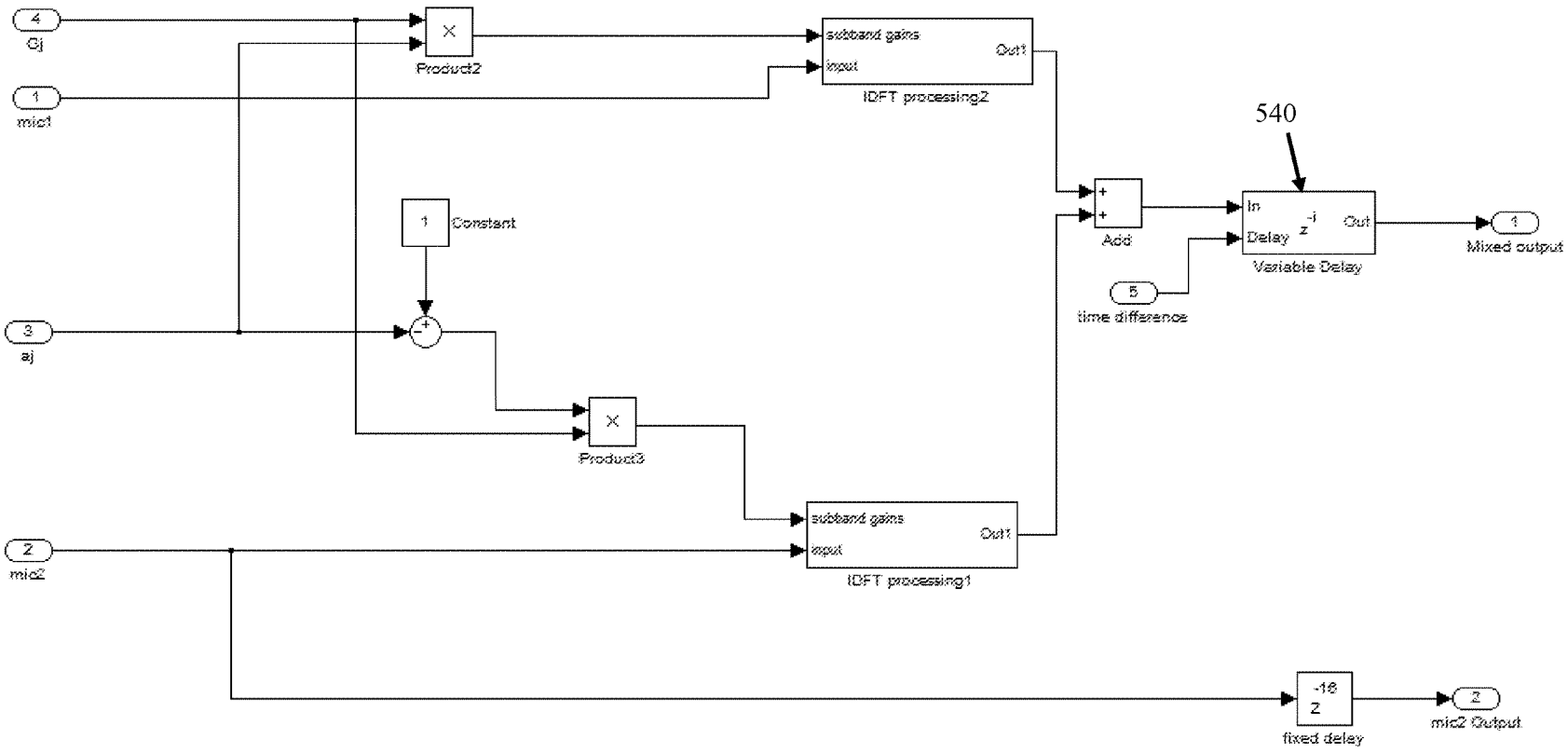
FIG. 5 is a schematic of a system for applying both emphasis gains and a time difference to affected subbands, in accordance with yet another embodiment of the invention.

FIG. 5 illustrates yet another embodiment of the invention in which both a time delay 540 and emphasis gains $G_j$ are used to reemphasise binaural cues.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of mixing microphone signals, the method comprising:

obtaining first and second microphone signals from respective first and second microphones;

selecting at least one affected subband of the first and second microphone signals;

mixing the at least one affected subband of the first microphone signal with the at least one affected subband of the second microphone signal to produce first and second mixed signals;

processing at least one reference subband of the first and second microphone signals in order to identify a binaural cue between the first and second microphone signals, the reference subband being distinct from the or each affected subband; and modifying the affected subband in the first and second mixed signals in order to re-emphasize the identified binaural cue;

wherein the mixing comprises weighted mixing of the signals from at least two microphones, in low frequency subbands, so that the signal which is suffering from least wind noise in each of the low frequency subbands is weighted more heavily in that subband for further processing in both of the mixed signals.

2. The method of claim 1 wherein identifying the binaural cue comprises analysing the reference subband in the first and second signals in order to identify a level, magnitude or power difference between the first and second signals in the reference subband.

3. The method of claim 2 wherein modifying the affected subband in the first and second mixed signals comprises applying respective first and second emphasis gains to the first and second mixed signals in the or each affected subband.

4. The method of claim 1 wherein identifying the binaural cue comprises analysing the reference subband in the first and second signals in order to identify a time difference between the first and second microphone signals.

5. The method of claim 4 wherein modifying the affected subb and in the first and second mixed signals comprises applying the time difference to the first and second mixed signals in the or each affected subband.

6. The method of claim 1 wherein the mixing comprises weighted mixing of the signals from at least two microphones, in middle-to-high frequency subbands, so that the signal which is suffering from least lens focus motor noise in each of the affected subbands is weighted more heavily in that subband for further processing in both of the mixed signals.

7. A device for mixing microphone signals, the device comprising:

first and second inputs for receiving respective first and second microphone signals from respective first and second microphones; and a digital signal processor configured to select at least one affected subband of the first and second microphone signals, mix the at least one affected subband of the first microphone signal with the and at least one affected subband of the second microphone signal to produce first and second mixed signals, wherein the mixing comprises weighted mixing of the signals from at least two microphones, in low frequency subbands, so that the signal which is suffering from least wind noise in each of the low frequency subbands is weighted more heavily in that subband for further processing in both of the mixed signals;

the digital signal processor further configured to process at least one reference subband of the first and second microphone signals in order to identify a binaural cue between the first and second microphone signals, the reference subband being distinct from the or each affected subband; and the digital signal processor further configured to modify the affected subband in the first and second mixed signals in order to re-emphasize the identified binaural cue.

8. The device of claim 7 wherein the digital signal processor is further configured to identify the binaural cue by analysing the reference subband in the first and second signals in order to identify a level, magnitude or power difference between the first and second signals in the reference subband.

9. The device of claim 8 wherein the digital signal processor is further configured to modify the affected subband in the first and second mixed signals by applying respective first and second emphasis gains to the first and second mixed signals in the or each affected subband.

10. The device of claim 7 wherein the digital signal processor is further configured to identify the binaural cue by analysing the reference subband in the first and second signals in order to identify a time difference between the first and second microphone signals.

11. The device of claim 10 wherein the digital signal processor is further configured to modify the affected subband in the first and second mixed signals by applying the time difference to the first and second mixed signals in the or each affected subband.

12. The device of claim 7 wherein the digital signal processor is further configured to mix the signals from at least two microphones using weighted mixing, in middle-to-high frequency subbands, so that the signal which is suffering from least lens focus motor noise in each of the affected subbands is weighted more heavily in that subband for further processing in both of the mixed signals.

13. A non-transitory computer readable medium for mixing microphone signals, comprising instructions which, when executed by one or more processors, causes performance of the following:

obtaining first and second microphone signals from respective first and second microphones;

selecting at least one affected subband of the first and second microphone signals;

mixing the at least one affected subband of the first microphone signal with the at least one affected subband of the second microphone signal to produce first and second mixed signals;

processing at least one reference subband of the first and second microphone signals in order to identify a binaural cue between the first and second microphone signals, the reference subband being distinct from the or each affected subband; and modifying the affected subband in the first and second mixed signals in order to re-emphasize the identified binaural cue;

wherein the mixing comprises weighted mixing of the signals from at least two microphones, in low frequency subbands, so that the signal which is suffering from least wind noise in each of the low frequency subbands is weighted more heavily in that subband for further processing in both of the mixed signals.

* * * * *